US007117907B2

(12) United States Patent
Mitchell

(10) Patent No.: US 7,117,907 B2
(45) Date of Patent: Oct. 10, 2006

(54) APPARATUS FOR ADJUSTABLY PROFILING A CANT

(75) Inventor: Rory M. Mitchell, Beaverton, OR (US)

(73) Assignee: COE Newnes/McGehee Inc., Salmon Arm (CA)

( * ) Notice: Subject to any disclaimer, the term of this patent is extended or adjusted under 35 U.S.C. 154(b) by 0 days.

(21) Appl. No.: 11/287,244

(22) Filed: Nov. 28, 2005

(65) Prior Publication Data

US 2006/0113003 A1 Jun. 1, 2006

Related U.S. Application Data

(60) Provisional application No. 60/630,590, filed on Nov. 26, 2004.

(51) Int. Cl.
*B27C 9/00* (2006.01)

(52) U.S. Cl. ..... 144/39; 144/3.1; 144/1.1

(58) Field of Classification Search ..... 144/3.1, 144/1.1, 2.1, 39, 359, 363, 369, 373, 376, 144/378

See application file for complete search history.

(56) References Cited

U.S. PATENT DOCUMENTS

| | | | | |
|---|---|---|---|---|
| 3,313,329 | A | 4/1967 | Mitten | |
| 3,442,310 | A | 5/1969 | Mitten et al. | |
| 3,554,250 | A | 1/1971 | Ulsky | |
| 3,738,404 | A | 6/1973 | Walker | |
| 4,239,069 | A | 12/1980 | Zimmerman | |
| 4,416,312 | A * | 11/1983 | Ostberg | 144/39 |
| 4,848,427 | A | 7/1989 | Reuter | |
| 4,879,659 | A | 11/1989 | Bowlin et al. | |
| 5,421,386 | A * | 6/1995 | Lundstrom | 144/357 |
| 5,435,361 | A * | 7/1995 | Knerr | 144/378 |
| 5,722,474 | A * | 3/1998 | Raybon et al. | 144/357 |
| 5,762,121 | A | 6/1998 | Rautio | |
| 6,062,281 | A * | 5/2000 | Dockter et al. | 144/357 |
| 6,178,858 | B1 * | 1/2001 | Knerr et al. | 83/76.8 |
| 6,688,351 | B1 * | 2/2004 | Stager et al. | 144/373 |
| 6,705,363 | B1 | 3/2004 | McGehee et al. | |
| 6,929,043 | B1 | 8/2005 | Woodford et al. | |
| 6,988,438 | B1 | 1/2006 | McGehee et al. | |
| 6,991,012 | B1 | 1/2006 | Mitchell et al. | |
| 2002/0112782 | A1 | 8/2002 | Brun | |

FOREIGN PATENT DOCUMENTS

| | | |
|---|---|---|
| CA | 2111893 | 6/1995 |
| EP | 0 933 177 A2 | 4/1999 |
| WO | WO 2005/087459 A1 | 9/2005 |

* cited by examiner

*Primary Examiner*—Bena Miller
(74) *Attorney, Agent, or Firm*—Antony C. Edwards

(57) ABSTRACT

An apparatus for adjustably profiling a cant comprising a first and second shaft rotatably mounted on a first and second frame, respectively. A first and second pair of laterally spaced apart profiling heads are slidably and rotatably mounted on the first and second shaft, respectively. Corresponding pairs of linear positioners laterally translate the first and second laterally spaced apart heads so that each profiling head in each pair of profiling heads may be independently translated relative to the other to set spacing, and then each pair may be sleeved cooperatively in unison. The pairs of profiling heads may be vertically displaced relative to the longitudinal centerline of a cant. The profiling heads remove notches from the wane corners of the cant.

8 Claims, 17 Drawing Sheets

APPARATUS FOR ADJUSTABLY PROFILING A CANT

CROSS REFERENCE TO RELATED APPLICATION

This application claims priority from U.S. Provisional Patent Application No. 60/630,590 filed Nov. 26, 2004 entitled Apparatus for Adjustable Profiling a Cant.

FIELD OF THE INVENTION

The present invention relates to a log processing machine, and more particularly, it relates to an apparatus for adjustably processing wane edge boards for production into useable dimension lumber.

BACKGROUND OF THE INVENTION

The processing of cants generally do not allow for efficient production of dimension lumber, especially when the cants have natural inherent irregularities, such as curvature and knots. A cant is conventionally defined as a log having at least two flat parallel faces. Typically, a processed cant produces a plurality of centre cant boards having flat parallel faces (i.e. useable dimension lumber) and a plurality of wane edge boards having non-flat faces from the curved surfaces of the cant. Such wane edge boards may be further processed or chipped to remove the curved surfaces in order to transform such boards into dimension lumber. However, such processes increase production costs and unnecessarily compromise recovery.

When processing a cant, typically, an upstream scanner and optimizer are used to determine the width and number of centre cant boards that can be processed from the cant. The scanner and optimizer also determine the size and width of any wane edge boards that can be milled from the curved sides of the cant and processed into dimension lumber. The methods and devices currently available in the art to profile and process wane edge boards into usable dimension lumber negatively affect recovery. Recovery, which is the most important factor in the lumber industry, refers to the amount of board feet recovered from cutting a cant into dimension lumber.

The existing methods and devices for processing wane edge boards are limited only to profiling the wane edge boards relative to the width of the centre cant boards in an orientation parallel with the direction of flow of the cant. For example, the rotational axes of the upper pair and lower pair of profiling heads available in the art are generally fixed at right angles to the direction of flow of the cant, thereby producing profiled wane edge boards without regard to the characteristics peculiar to the cant being processed. Such methods and devices for profiling wane edge boards fail to adapt to and accommodate any natural inherent irregularities of cants which can be accomplished by following the natural longitudinal centreline of the cant. For example, if the cant has a curvature in the horizontal plane, profiling heads which are generally fixed at right angles will not be able to maintain a path parallel to the longitudinal centreline of the cant, causing the profiled wane edge boards to be shortened relative to the maximum cant length. This limitation does not permit maximum recovery of the cant because the profiler produces profiled wane edge boards that fail to utilize the full length of the cant. The wane edge boards may be reduced in width or size to accommodate the deficiencies in the cant. However, this results in a reduction of lumber recovery volume and value as well.

Therefore, it is desirable to effectively process cants into useable dimension lumber by producing the maximum number of center cant boards and processing the remaining curved sides of the cant in an economical manner to produce the maximum number of profiled wane edge boards.

SUMMARY OF THE INVENTION

The present invention provides an apparatus for adjustably profiling a cant wherein cutting devices such as profiling heads and chipping heads are capable of slewing (i.e. lateral and vertical displacement) and skewing (i.e. angular displacement) with respect to the longitudinal centreline of a cant. Slewing and skewing of the cutting devices enables removal of the wane edges on the cant while accommodating any structural irregularities of the cant, thereby enabling an increased production of useable dimension lumber. The apparatus allows for skewing and slewing of profiling heads, which removes notches from the wane corners of the cant. The apparatus also allows for skewing and slewing of chipping heads which removes a wane surface from a cant to produce parallel flat faces on a cant. In one embodiment, the two profiling assemblies may be combined together in one apparatus.

The apparatus for adjustably profiling a cant may include a means for angularly displacing the profiling heads and chipping heads relative to the centreline of the cant to accommodate and adapt to any natural defects of the cant. The apparatus may also include a means for laterally displacing the profiling heads and chipping heads relative to the centreline of the cant to accommodate and adapt to any natural defects of the cant. The apparatus may also include a means for vertically displacing the profiling heads and chipping heads relative to the centreline of the cant to accommodate and adapt to any natural defects of the cant. The apparatus may thus improve the processing of a cant into dimension lumber by accommodating most deficiencies of a cant, thereby increasing the recovery and value of the cant.

In accordance with the present invention, there is provided a first shaft and a second shaft rotatably mounted on a first frame and a second frame, respectively. A first, upper, cutting device includes a pair of laterally spaced apart cutting heads, laterally spaced apart on either side of a cant feed path. A second, lower, cutting device includes a pair of laterally spaced apart cutting heads, also laterally spaced apart on either side of the cant feed path. The first and second cutting devices are vertically spaced apart on opposite upper and lower sides of the cant feed path. The first and second cutting devices are rotatably and slidably mounted on the first and second shafts, respectively. The first and second cutting devices may displace laterally, vertically, and angularly relative to the longitudinal centreline of a cant.

A first pair of linear positioners is mounted to the first frame to laterally displace the pair of cutting heads of the first cutting device relative to the longitudinal centreline of the cant. A second pair of linear positioners is mounted to the second frame to laterally displace the pair of cutting heads of the second cutting device relative to the longitudinal centreline of the cant. The linear positioners may move each cutting head independently of the other cutting head in the pair so as to set the spacing between the pair of cutting heads, and may move the pair of cutting heads simultaneously, that is, in unison laterally across the feed path so as to slew the pair, while maintaining a constant spacing between the pair, as the cant passes through and between the cutting devices. Vertical linear positioners are mounted to the first and the second frames to vertically displace the first and the second cutting devices relative to the longitudinal centreline of the cant. The first and the second cutting devices may thus be selectively independently or cooperatively displaced vertically relative to the longitudinal centreline of the cant and to each other. The cutting heads within the cutting devices may also be independently or cooperatively, that is in unison, displaced laterally. Each of the cutting devices may also be displaced angularly to skew the cutting heads relative to the feed path or the centreline of the cant. The linear positioners may be pneumatically or hydraulically or electro/mechanically driven actuators, each having an extendable and retractable arm for displacement of the first and the second cutting devices or the cutting heads within the cutting devices.

The first and second cutting devices may be angularly displaced in a horizontal plane by corresponding first and second cams. The first and second cams are eccentrically mounted, and rotate about corresponding vertical shafts. Rotation of the first and second cams causes the first and second cams to bear against the first and second frames respectively, thereby transferring movement of the first and second cams to the first and second frames. This causes the first and the second cutting devices to displace angularly relative to the feed path.

Advantageously, the first and the second cutting devices may be profiling heads for removing a notch from and along the wane corners of the cant, thereby enabling production of useable dimension lumber between the notches when the cant passes through a saw box downstream of the profiling heads. In one embodiment of the present invention, the apparatus may include both a chipping head assembly and a profiling head assembly, advantageously with the chipping head assembly upstream of the profiling head assembly.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EMBODIMENTS OF THE INVENTION

Figures 1, 1A, 1B:
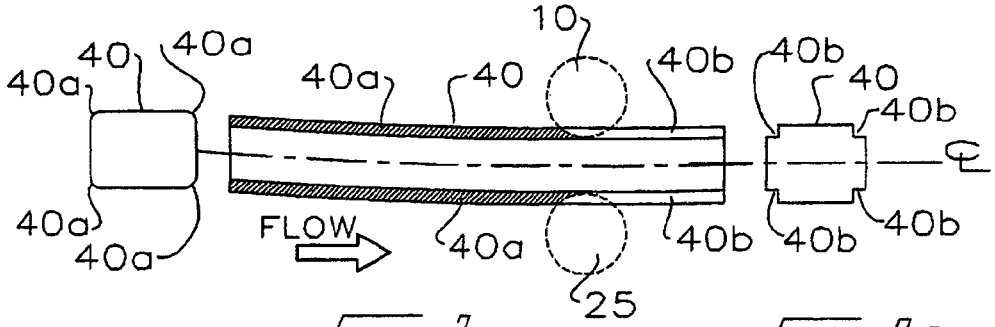
FIG. 1 is a side elevation diagrammatic view of a four-sided cant moving through a pair of vertically spaced apart profiling heads.
FIG. 1*a* is a left end elevation view of the cant of FIG. 1.
FIG. 1*b* is a right end elevation view of the cant of FIG. 1.

With reference to the Figures wherein similar characters of reference denote corresponding parts in each view, the apparatus for adjustably profiling a cant includes a splined shaft 5 mounted so as to be rotatably journalled through a frame 7. A laterally spaced apart pair of profiling heads 10 and 15 are mounted onto shaft 5. A second splined shaft 20 is similarly mounted so as to be rotatably journalled through a second frame 22. A second laterally spaced apart pair of profiling heads 25 and 30 are mounted onto second shaft 20.

Preferably, shaft 5 and shaft 20 are mounted horizontally. Profiling heads 10 and 15 and profiling heads 25 and 30 are slidably mounted on to the splines of shaft 5 and shaft 20, respectively, so as to enable lateral displacement, both independent and in unison, of the profiling heads along the shafts. The profiling heads remove notches 40*b* from and along wane corners 40*a* of cant 40 so as to remove remaining wane on four-sided cants. Profiling heads 10 and 15, and 25 and 30 are rotatable on shafts 5 and 20, respectively, by a drive assembly a motor 31, a drive belt 32, and a drive shaft 33. In an embodiment of the invention, a first drive assembly is operably coupled with shaft 5 and a second drive assembly is operably coupled with shaft 20, and the first and second drive assemblies are mounted to a housing that supports first frame 7 and second frame 22.

Profiling heads 10 and 15, and 25 and 30 may be laterally displaced both independently and in unison relative to the longitudinal centreline of a cant 40. That is, profiling heads 10 and 15 may be translated laterally independently of each other to set spacing between them, and also moved in unison to maintain the spacing and to track or slew laterally as required by the optimized recovery solution from the optimizer (not shown). Similarly, profiling heads 25 and 30 may be translated laterally independently of each other to set spacing between them, and also moved in unison to maintain the spacing and to track or slew laterally as required by the optimized recovery solution from the optimizer (not shown). Linear positioners 35 and 36 are mounted to frame 7 to selectively laterally displace profiling heads 15 and 10 respectively. Similarly, second linear positioners 45 and 46 are mounted to frame 22 to selectively laterally displace profiling heads 30 and 25 respectively. First linear positioners 35 and 36 and second linear positioners 45 and 46 may be pneumatic or hydraulic, or electro/mechanical actuators, each having an extendable and retractable arm. Linear positioners 35 and 36, and linear positioners 45 and 46 are selectively actuable in response to actuation signals sent from an optimizer via a programmable logic controller (not shown) so as to optimize the cutting solution of cant 40. When actuated, linear positioners 35 and 36, and linear positioners 45 and 46, respectively, independently laterally displace profiling heads 15 and 10, and 30 and 25. Preferably, linear positioners 35 and 36 are mounted to frame 7 adjacent and parallel to shaft 5, and linear positioners 45 and 36 are mounted to frame 22 adjacent and parallel to shaft 20.

Figures 3, 4, 5:
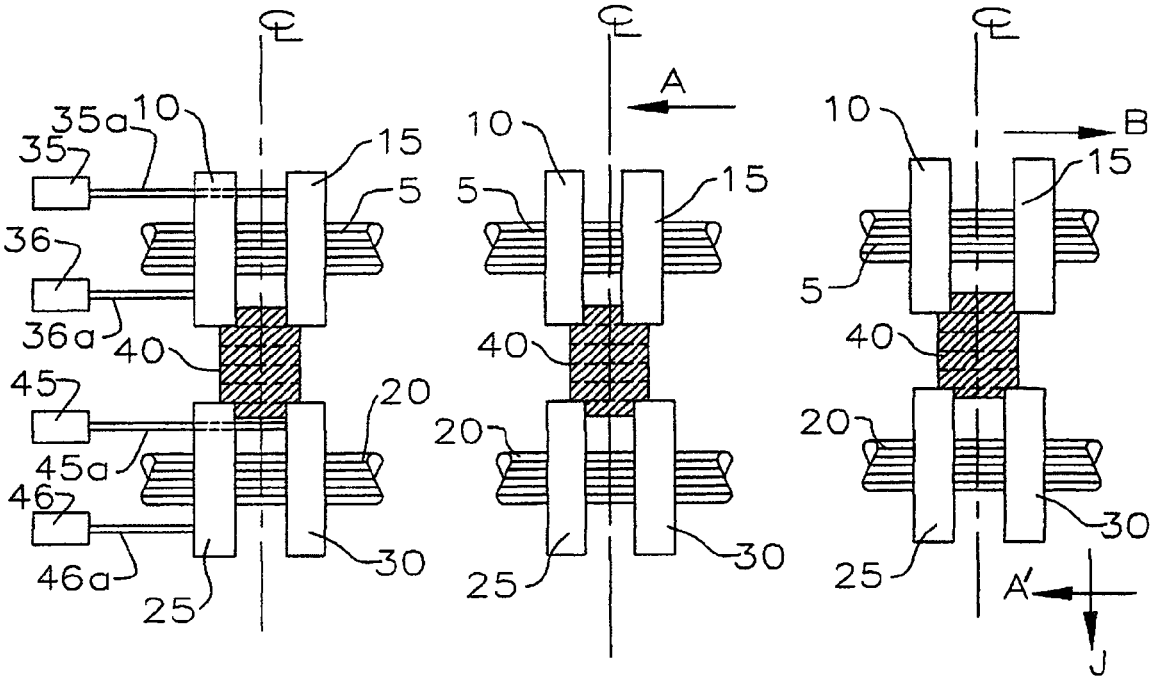
FIG. 3 is an end elevation diagrammatic view of upper and lower profiling heads engaging an upper and lower surface of a cant, where the upper and lower profiling heads are both symmetrically spaced apart relative to the centreline of the cant.
FIG. 4 is the end elevation diagrammatic view of FIG. 3 wherein at least one of the upper profiling heads are laterally displaced towards the longitudinal centreline of the cant.
FIG. 5 is an end elevation diagrammatic view of FIG. 3 wherein the upper profiling heads are laterally displaced away from the centreline of the cant and the lower profiling heads are laterally displaced towards the centreline of the cant.
Figure 2A:
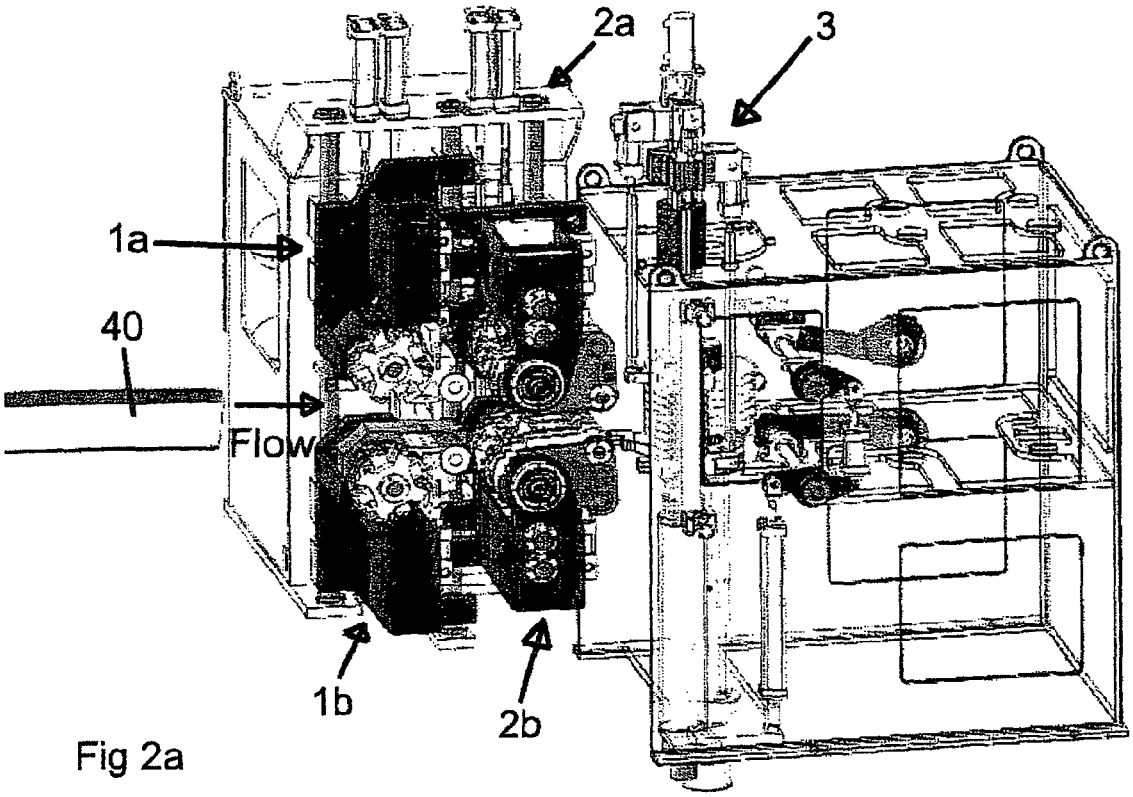
FIGS. 2*a*–2*f* are a progressive sequence of right side front perspective views of the chipping head and profiling head assemblies of FIG. 14 upstream of a vertical arbor curve sawing gang showing a cant being, canted into a four-sided cant, profiled to recover top and bottom boards, and curve sawn into dimension lumber.
Figure 2B:
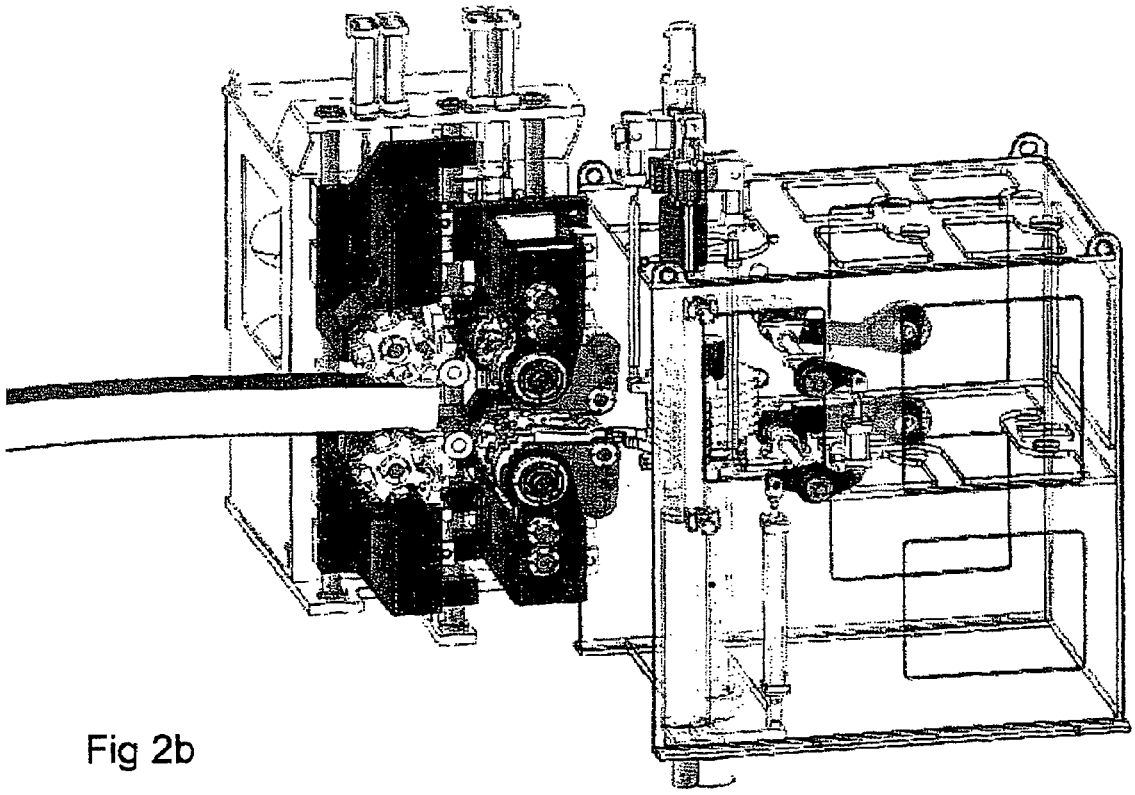
Figure 2C:
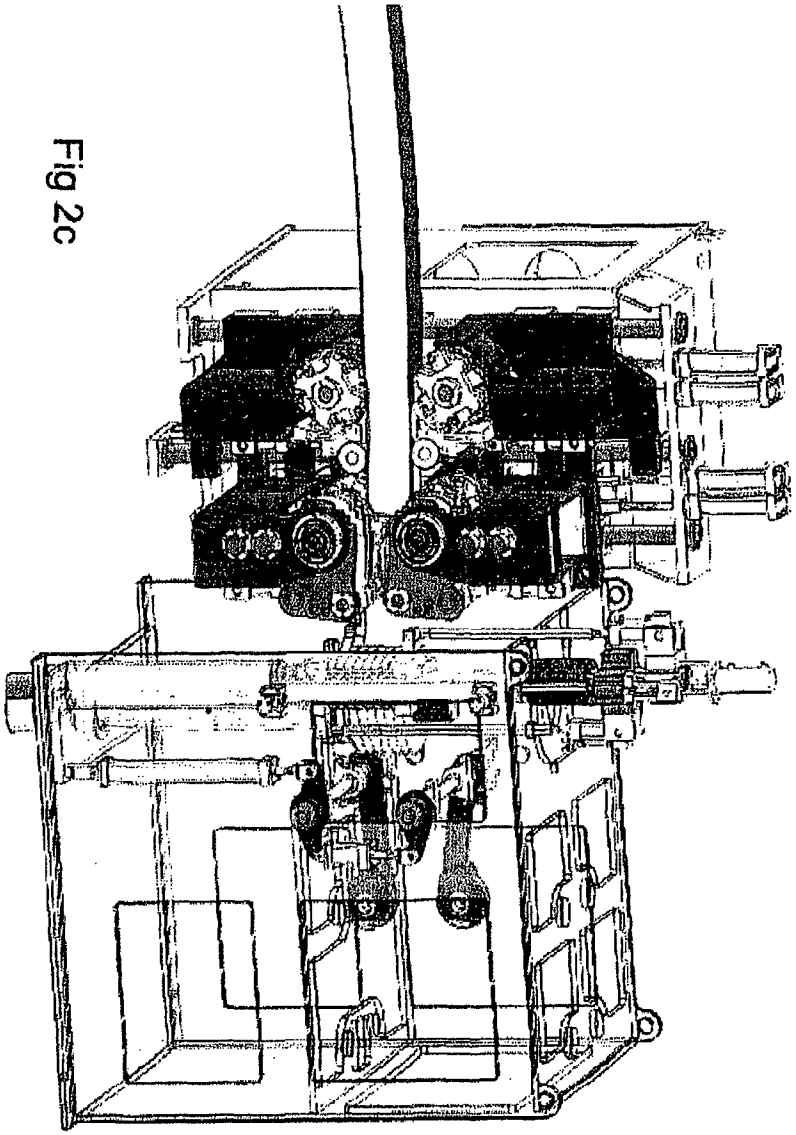
Figure 2D:
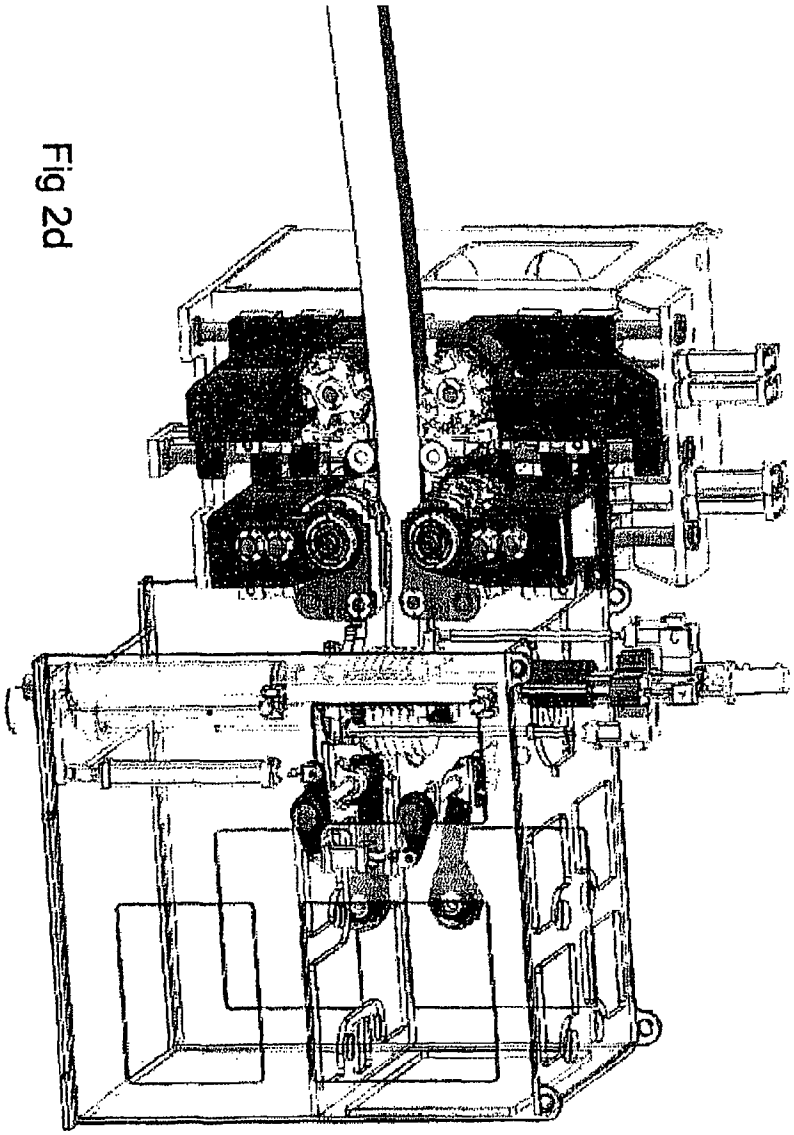
Figure 2E:
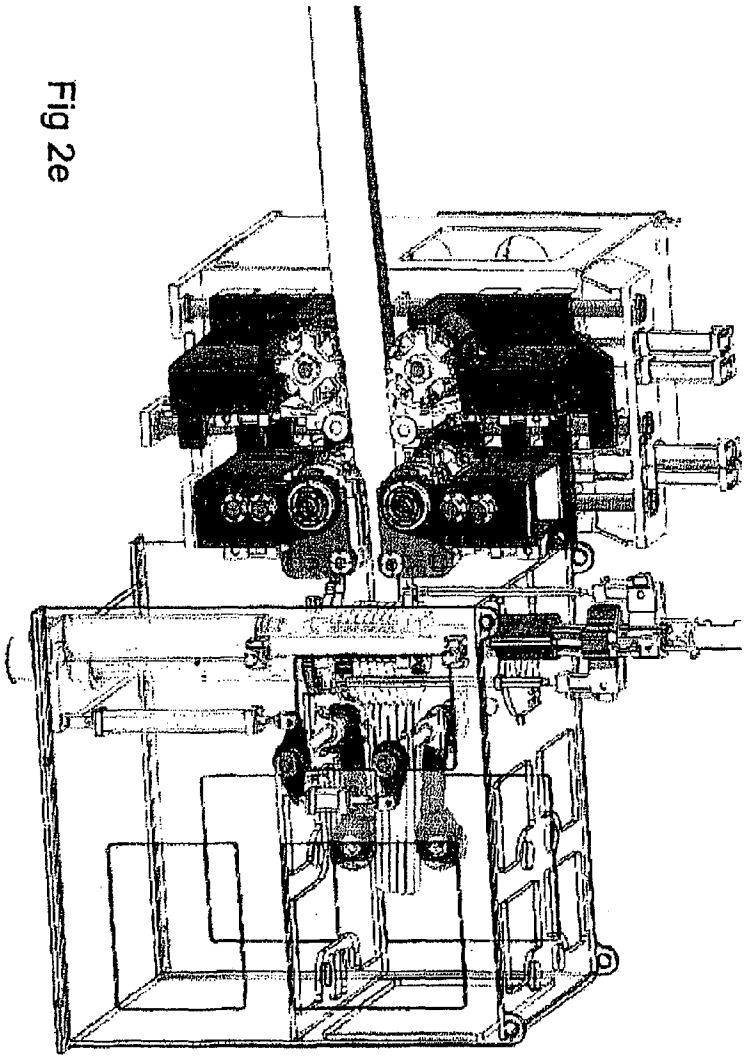
Figure 2F:
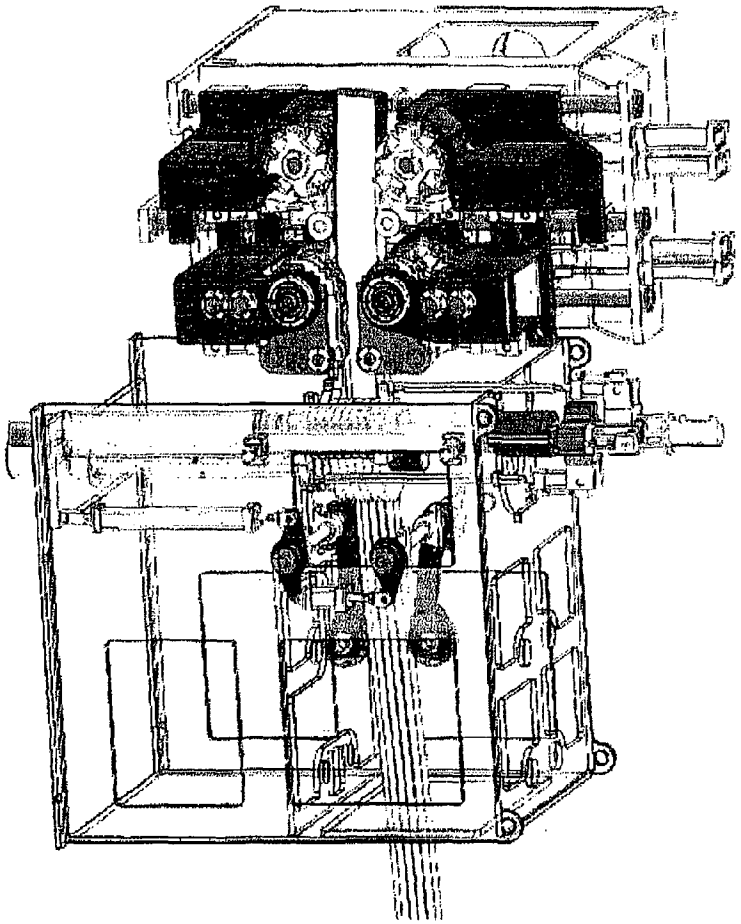

Extension and retraction of the extendable and retractable arms 35*a*, 36*a*, 45*a*, and 46*a* of respectively, linear positioners 35 and 36, and linear positioners 45 and 46 laterally displace the profiling heads 10 and 15, and 25 and 30 so as to, for example accommodate superficial irregularities or longitudinal taper of cant 40. In the example of FIG. 4, profiling head 15 may independently displace laterally in direction A towards the longitudinal centreline CL of cant 40 relative to both the profiling head 10 and to the second pair of profiling heads 25 and 30. In the further example of FIG. 5, profiling heads 10 and 15 may displace laterally in unison in direction B so as to slew relative to the longitudinal centreline of cant 40 as cant 40 translates longitudinally through the profiler in the Flow direction, while profiling heads 25 and 30, independent of heads 10 and 15, selectively cooperatively displace in unison laterally in direction A' relative to the longitudinal centreline of cant 40.

In a preferred embodiment of the invention, profiling heads 10 and 15, and 25 and 30 may also be selectively cooperatively or independently displaced angularly relative to the longitudinal centreline CL of cant 40 in order to bring heads 10 and 15, and 25 and 30 incrementally into general alignment with the shape of cant 40 according to the optimized solution. For example, heads 10 and 15 may selectively cooperatively displace angularly away from the longitudinal centreline of cant 40 independent of any angular displacement of heads 25 and 30. Typically, heads 10 and 15 and heads 25 and 30 are capable of displacing at least 1½ degrees from the longitudinal centreline CL of cant 40.

Figure 6:
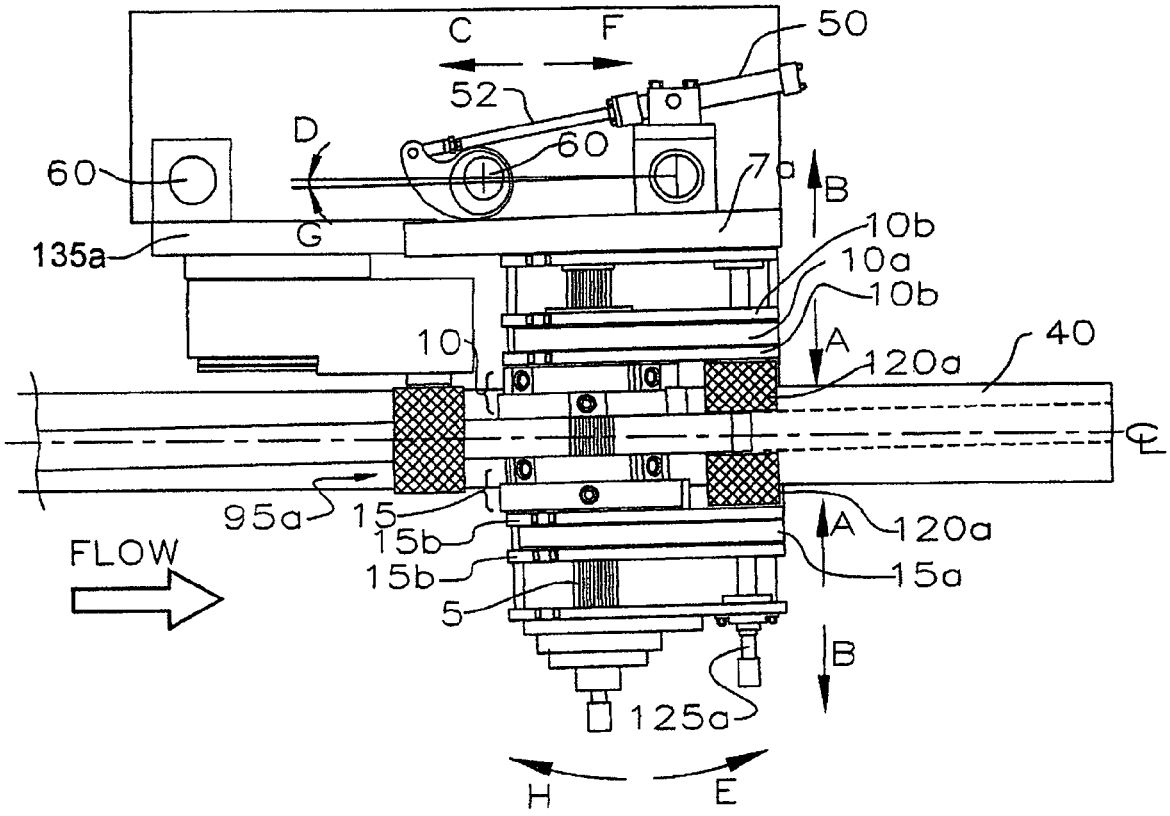
FIG. 6 is a plan view illustrating the linear positioner for angularly displacing the upper profiling heads.
Figure 6A:
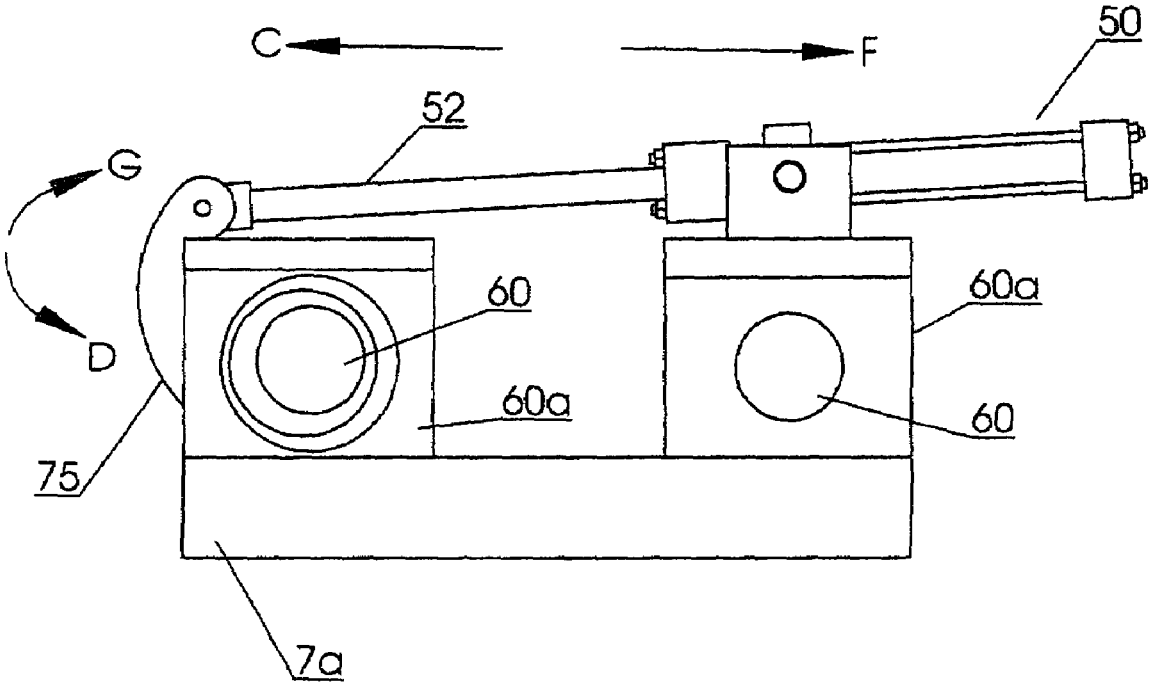
FIG. 6*a* is a plan view of the linear positioner in FIG. 6 with its arm retracted to approximately mid-stroke.
Figure 6B:
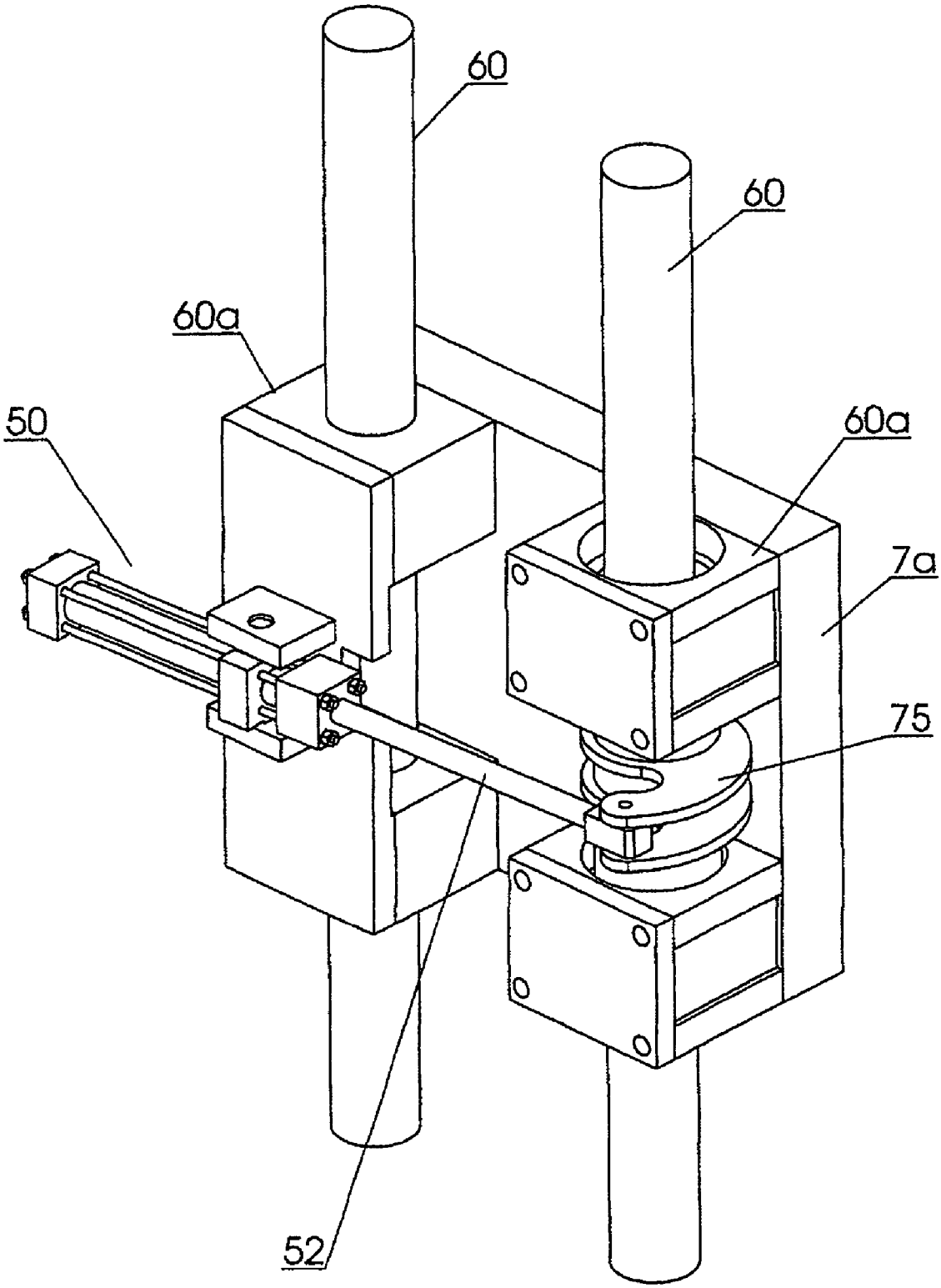
FIG. 6*b* is a perspective view of the linear positioner in FIG. 6 with its arm retracted to approximately mid-stroke.

Linear positioner 50 is mounted to frame 7 to selectively angularly displace in unison heads 10 and 15 relative to the longitudinal centreline CL of cant 40. Linear positioner 55 is mounted to frame 22 to selectively angularly displace heads 25 and 30 relative to the longitudinal centreline of cant 40. Linear positioner 50 and linear positioner 55 may be pneumatic or hydraulic actuators or electro/mechanical (not shown), each having an extendable and retractable arm. Linear positioners 50 and 55 are selectively actuable in response to actuation signals sent from the optimizer so as to optimize the profiling and cutting solution of cant 40. Cylinders are perpendicular to shaft 60 inside cam 75 as best seen in FIGS. 6*a* and 6*b*.

Figure 7:
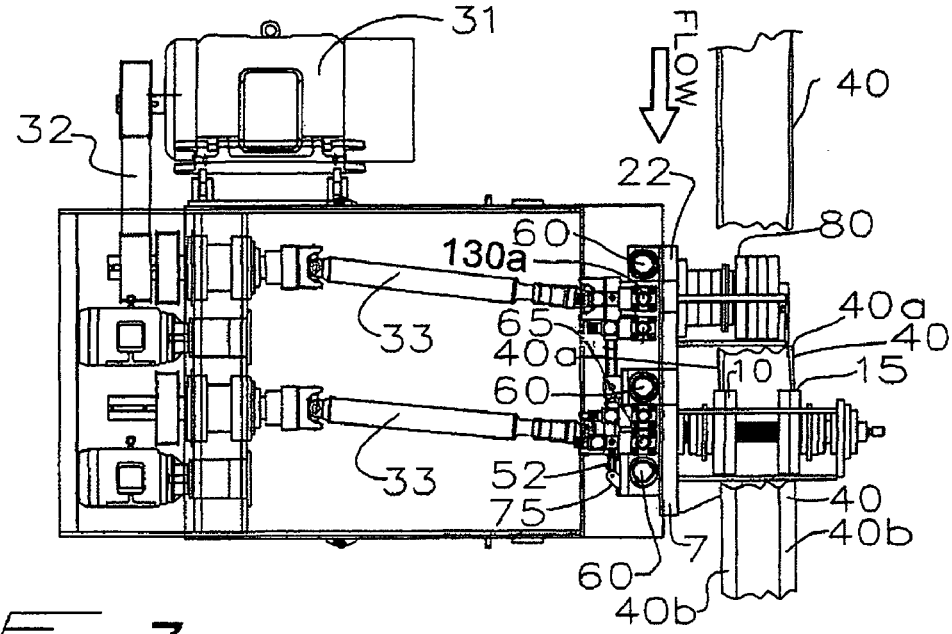
FIG. 7 is a plan view of the cant processing mechanism of FIG. 6.
Figure 8:
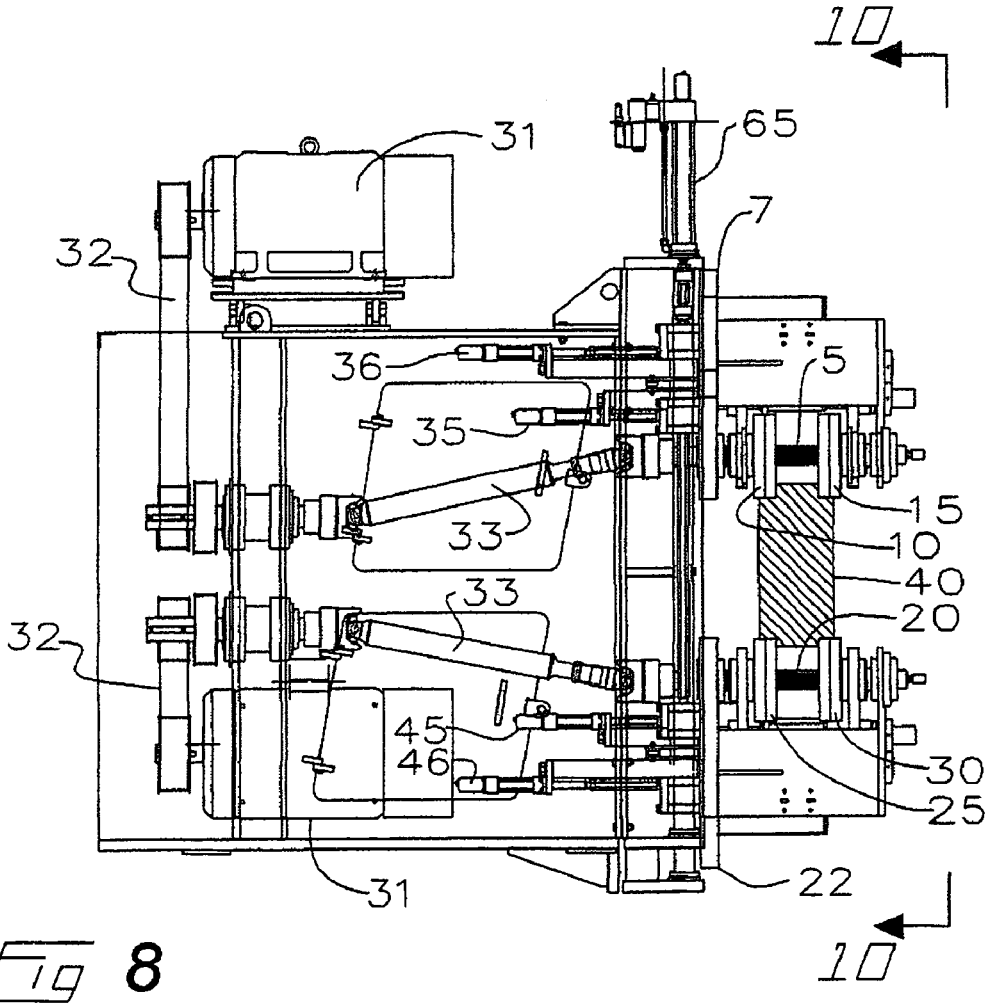
FIG. 8 is an end elevation view of the cant processing mechanism of FIG. 7.
Figure 9:
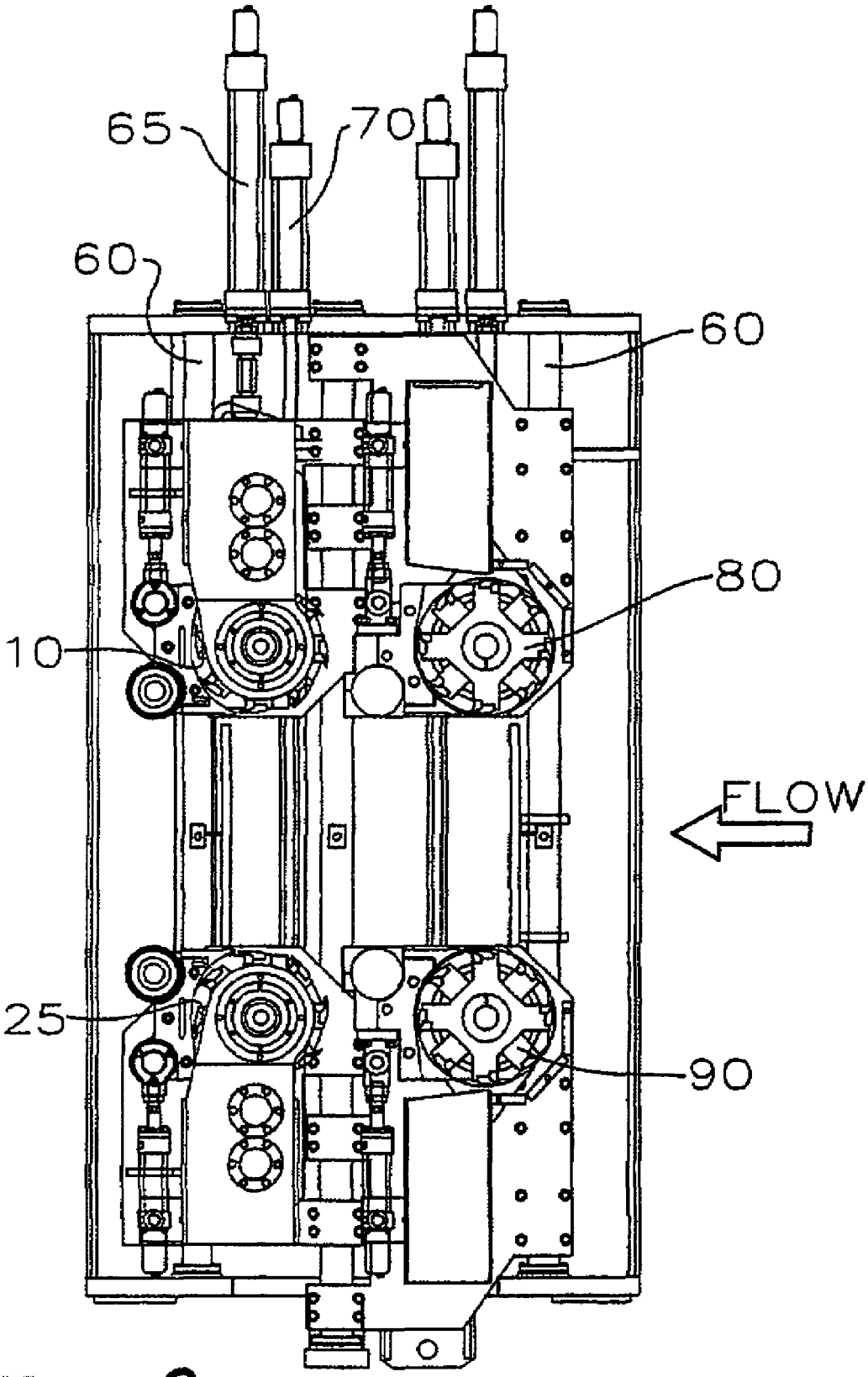
FIG. 9 is an end view taken on line 9—9 of FIG. 8.

When actuated, linear positioner 50 acts on cam 75 so as to cause cam 75 to exert pressure against frame 7, thereby angularly displacing heads 10 and 15 with respect to the longitudinal centreline CL of cant 40. As better seen in FIG. 7*a*, linear positioner 50 angularly displaces heads 10 and 15 by way of extension and retraction of a pneumatically or hydraulically or electro/mechanical actuated first arm 52 which rotates cam 75. Cam 75 is pivotally mounted by conventional means to arm 52 such that when arm 52 extends in direction C, first cam 75 rotates in direction D about a vertical shaft 60 at right angles to the axis of rotation of shaft 5. Shaft 60 is journalled through first cam 75 such that first cam 75 is rotatably and eccentrically mounted to shaft 60. Rotational movement of first cam 75 in direction D causes first cam 75 to bear against first frame 7, thereby transferring movement to first frame 7 and causing heads 10 and 15 to displace angularly in direction E with respect to the centreline CL of cant 40. When first arm 52 retracts in direction F, first cam 75 rotates in direction G, causing heads 10 and 15 to displace angularly in direction H with respect to the centreline CL of cant 40. Similarly, linear positioner 55 acts on a second cam so as to cause the second cam to exert pressure against frame 22, thereby angularly displacing heads 25 and 30 with respect to the longitudinal centreline CL of cant 40. When the extendable/retractable arm of linear positioner 55 extends, the second cam rotates about a second vertical shaft journalled through the second cam such that the second cam bears against frame 22, thereby causing heads 25 and 30 to displace angularly in direction E with respect to the centreline CL of cant 40

In a further preferred embodiment of the invention, heads 10 and 15 and heads 25 and 30 may also be vertically displaced relative to cant 40 to accommodate for example any natural defects or irregularities of cant 40. A linear positioner 65 cooperating with frame 7 selectively vertically displace heads 10 and 15 relative to cant 40. Similarly, linear positioner 70 cooperating with frame 22 selectively vertically displaces heads 25 and 30 relative to cant 40. Linear positioners 65 and 70 may be pneumatic or hydraulic actuators electro/mechanical, each having an extendable and retractable arm. Linear positioners 65 and 70 may be selectively actuable in response to actuation signals sent from an optimizer so as to optimize the profiling and cutting solution of cant 40.

A vertical shaft 60 is slidably journalled through frame 7 and frame 22.

In an embodiment of the invention, cant 40 is first processed by upstream chipping heads to remove most of the wane surfaces of cant 40, thereby producing a cant having four flat parallel surfaces and wane corners 40*a*. Cant 40 is processed by downstream profiling heads to remove the wane corners that remain after cant 40 has been processed by the chipping heads. Removal of the wane corners creates a notch 40*b* along each of the corners extending along the length of cant 40 such that a small profiled board may be formed between the notches and later sawn as cant 40 passes through the vertical arbor gangsaw in the saw box to produce useable dimension lumber. Lumber recovery is enhanced by eliminating the need for further processing of a wane edged board and eliminating the need for excessive chipping of the cant.

Figure 10:
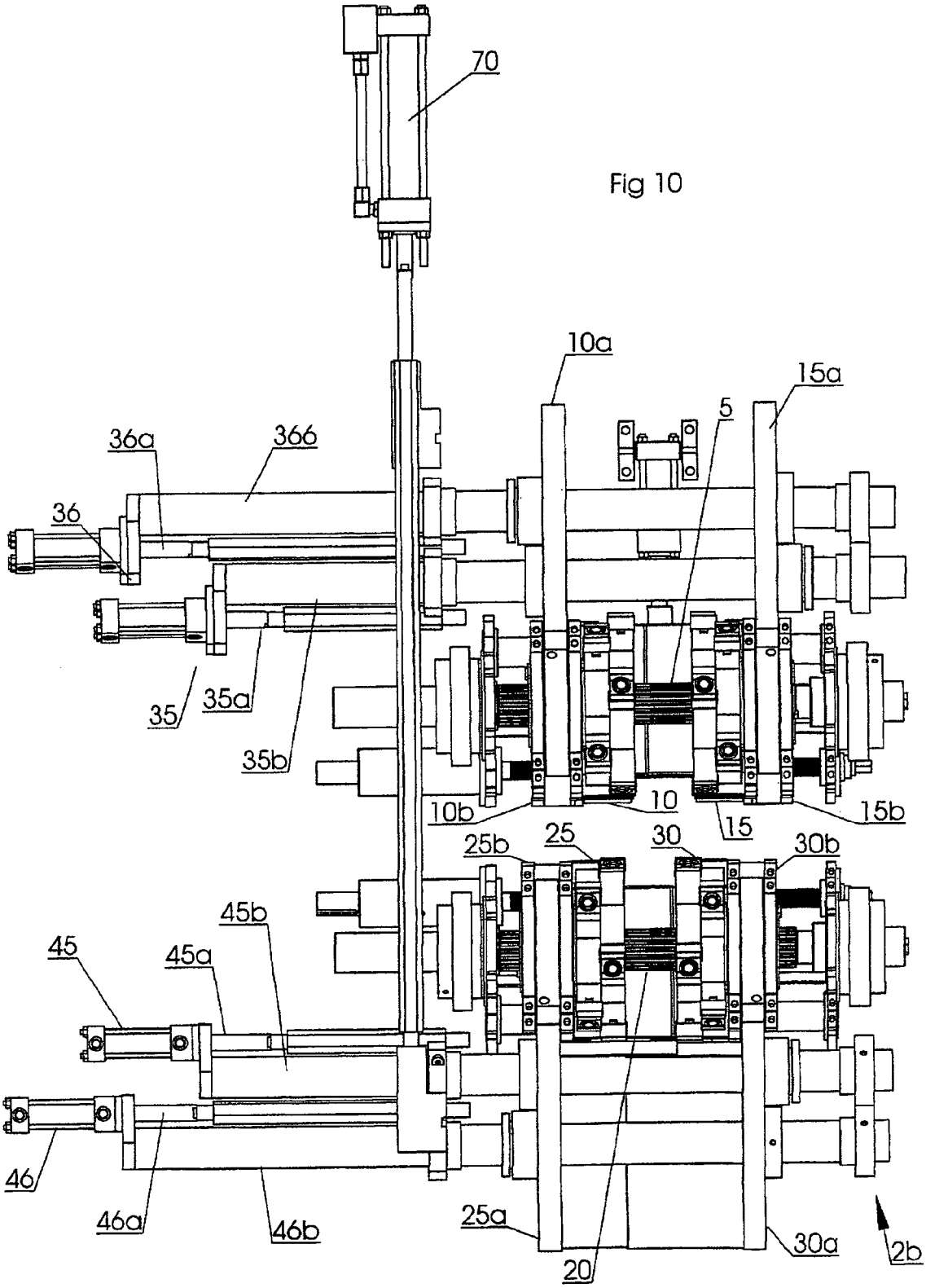
FIG. 10 is, in partially cut away front elevation view with the carriage frames removed, the upper and lower profiling head assemblies according to one embodiment of the present invention.
Figure 11:
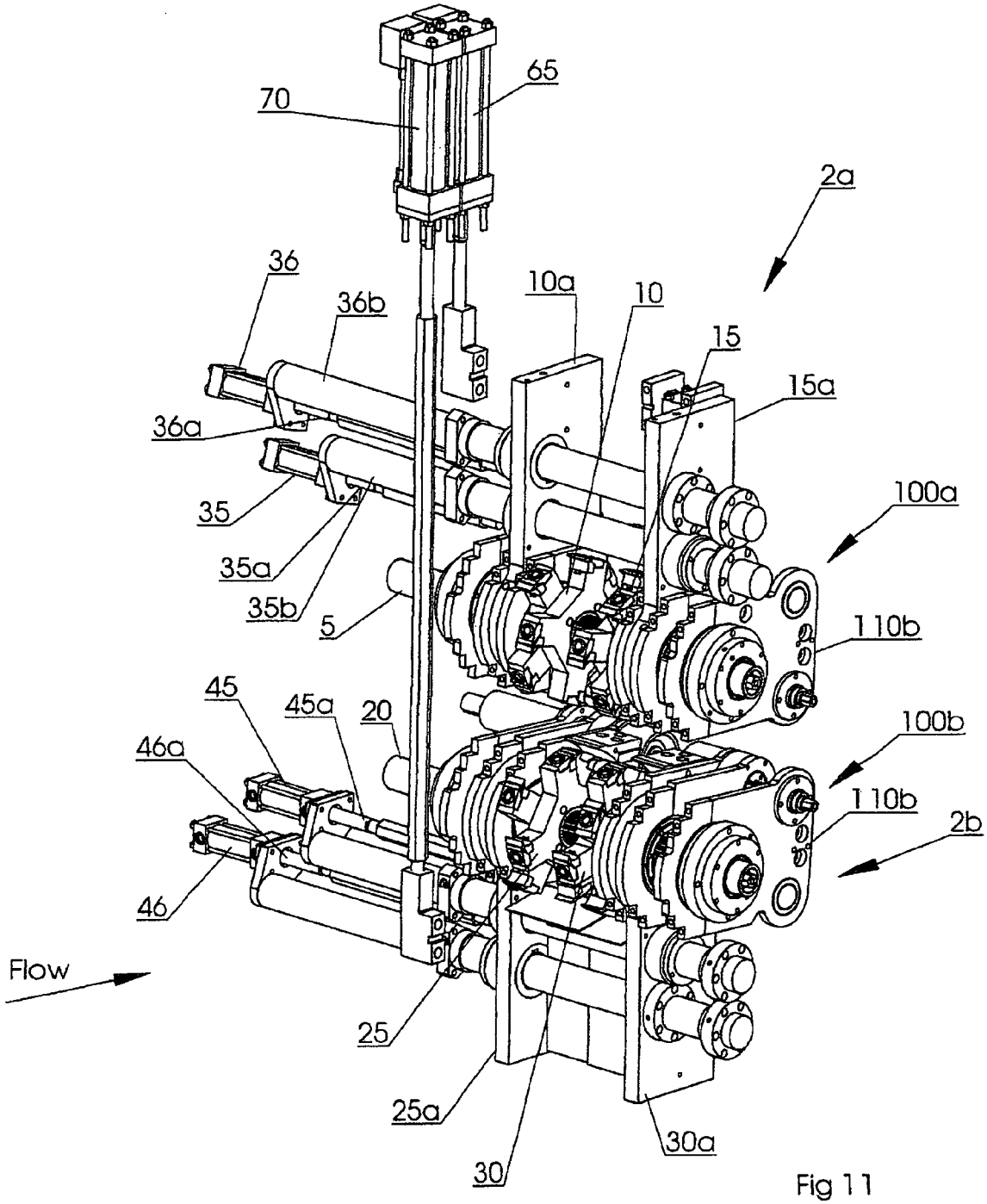
FIG. 11 is a right side front perspective view of the profiling head assemblies of FIG. 11.
Figure 12:
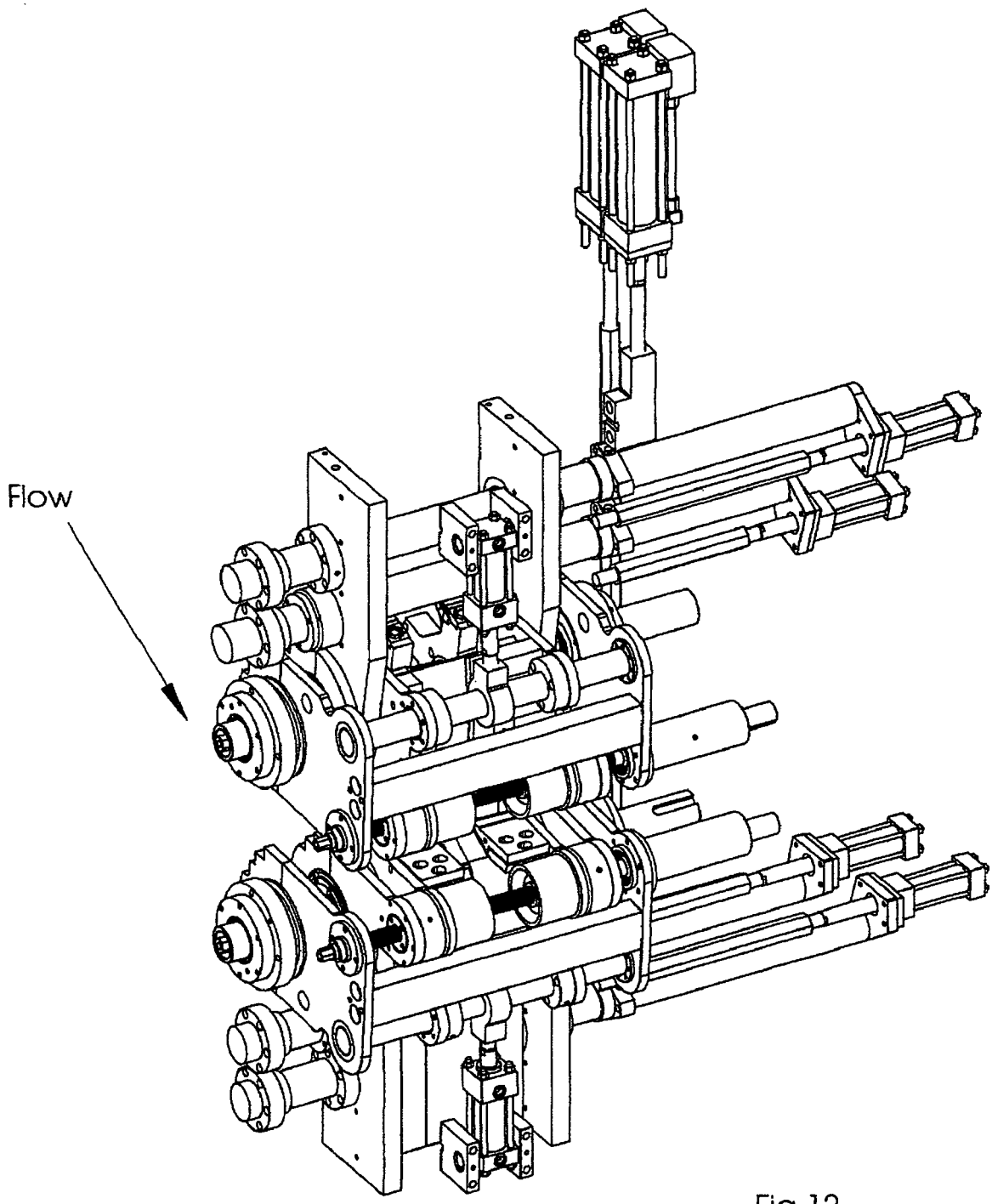
FIG. 12 is a right side rear perspective view of the profiling head assemblies of FIG. 11.
Figure 13:
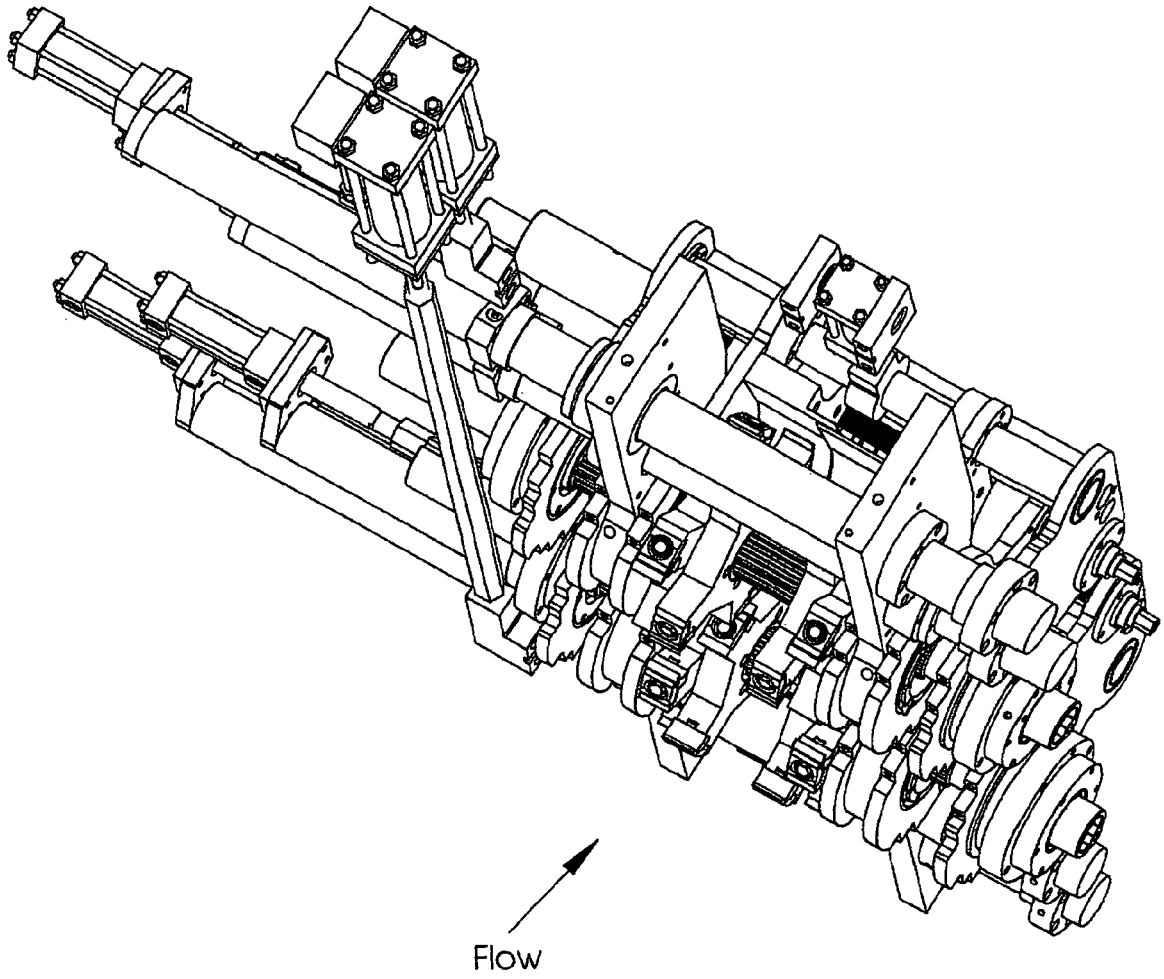
FIG. 13 is a right side top perspective view of the profiling head assemblies of FIG. 11.
Figure 14:
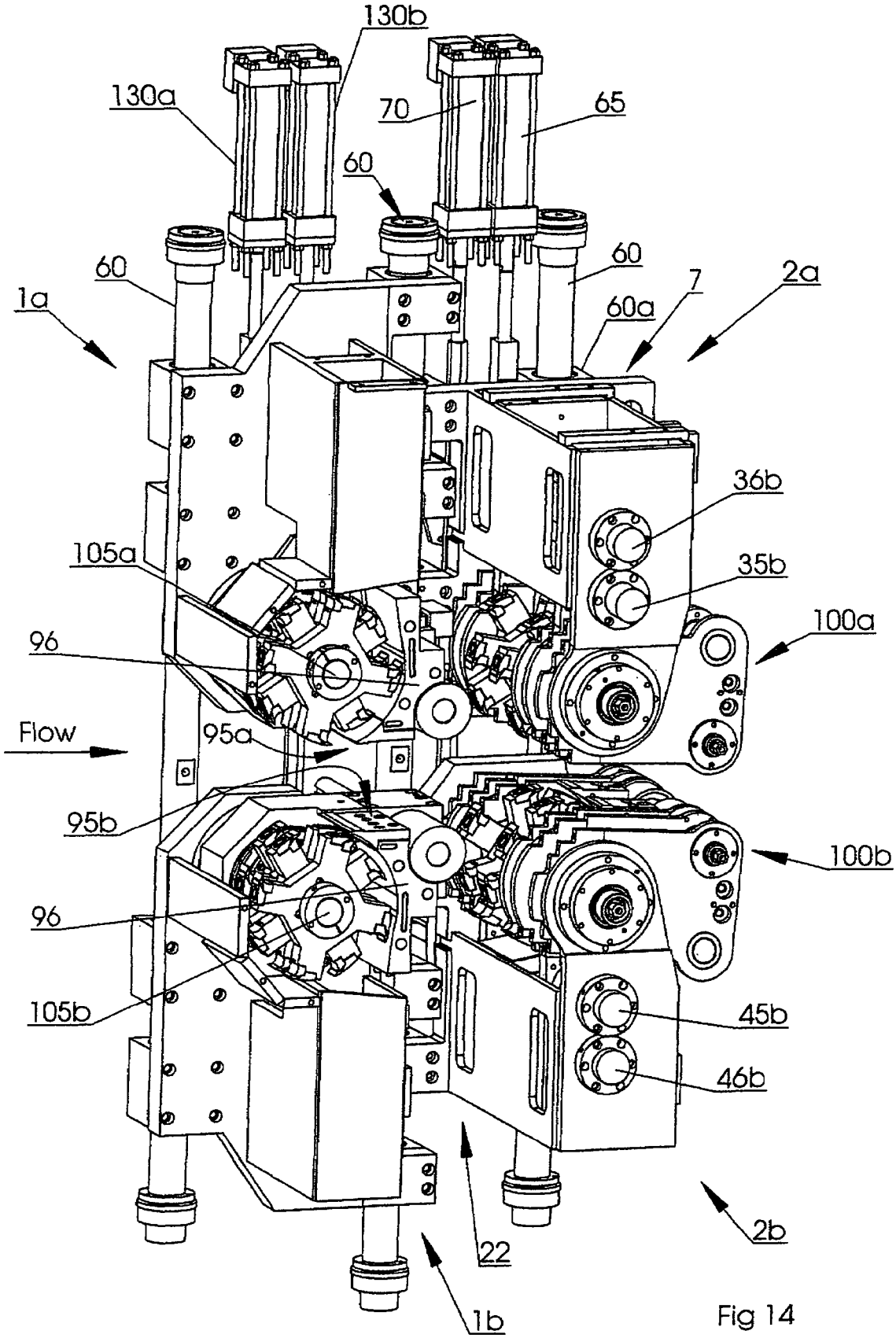
FIG. 14 is a right front perspective view of upper and lower chipping head assemblies and the chipping head assemblies of FIG. 10 showing their carriage frames.
Figure 15:
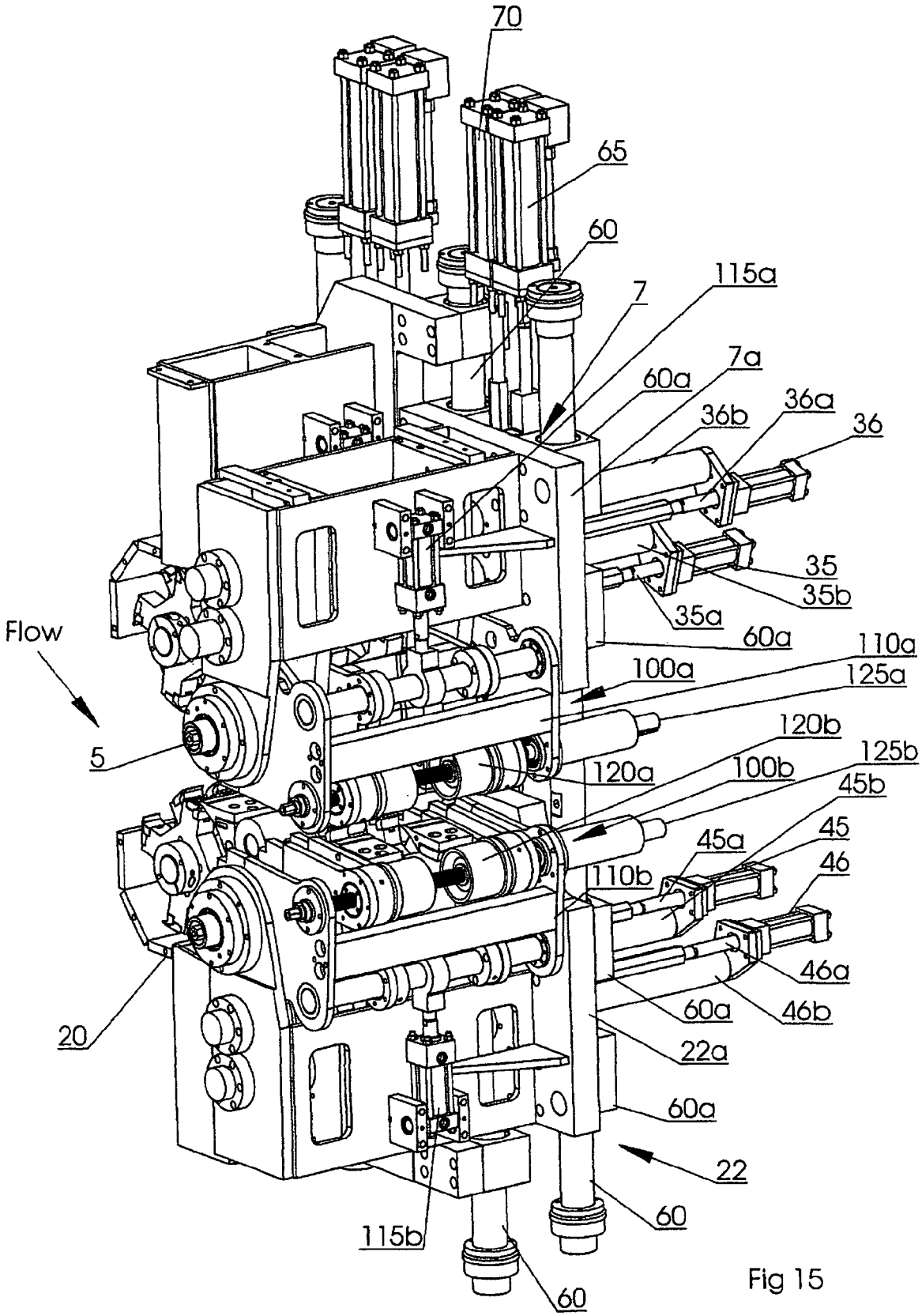
FIG. 15 is, in ride side rear perspective view of the chipping head and profiling head assemblies of FIG. 14.
Figure 16:
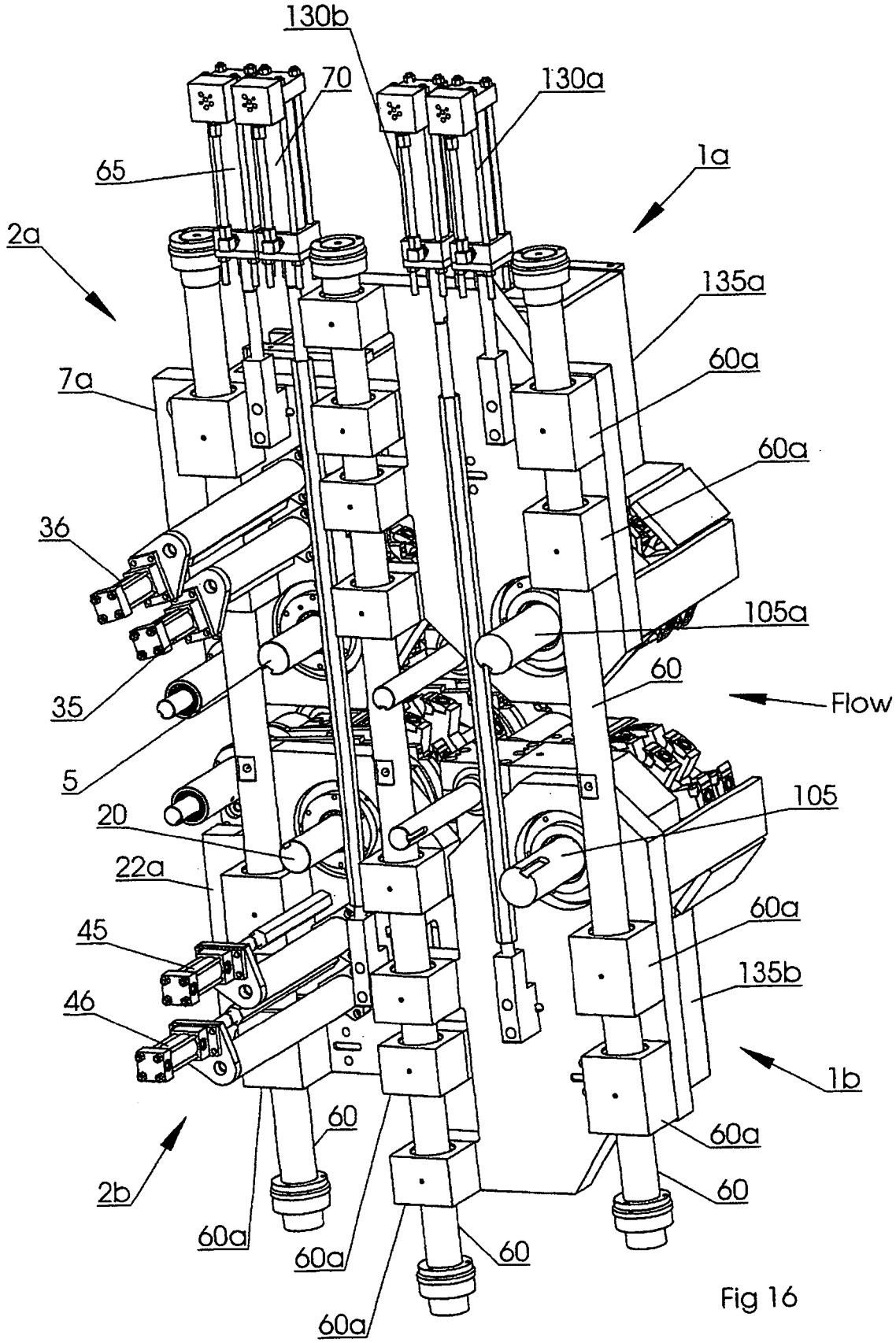
FIG. 16 is a left side front perspective view of the chipping head and profiling head assemblies of FIG. 14.
Figure 17:
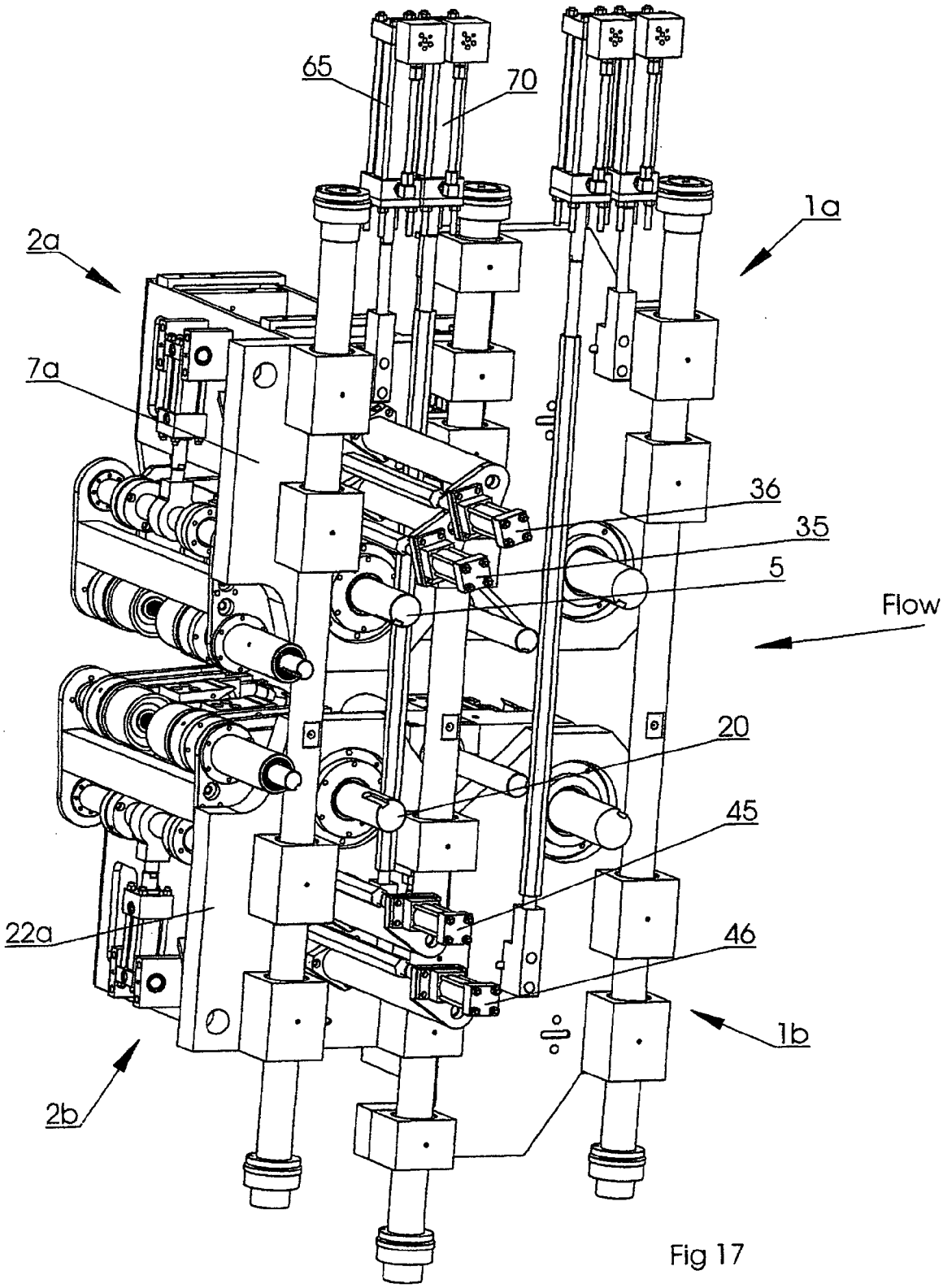
FIG. 17 is a left side rear perspective view of the chipping head and profiling head assemblies of FIG. 14.

As seen in the more detailed views commencing in FIG. 10, in the embodiment where an incoming two-sided cant 40 is chipped immediately upstream of the profiler so as to produce a four-sided cant entering into the profiler, as best seen commencing in FIG. 14 a vertically opposed pair of chipping heads are mounted on a separate set of vertically translatable frames 135*a* and 135*b* respectively so that the upper chipping heads and the lower chipping heads may be vertically translated selectively and independently according to instructions from the optimizer operating on scanned image data from an upstream scanner (not shown). The upper and lower chipping heads are selectively vertically translatable on their corresponding frames by means of vertically aligned linear positioners 130*a* and 130*b*.

The lateral linear positioners 35, 36, and 45, 46, are arranged so that the upper pair of lateral positioners are mounted in tandem so as to be adjacent and parallel, and similarly, the lower lateral positioners are mounted in tandem so that in each of the tandem pairs, one of the lateral positioners extends a shorter distance through the frame plate 7*a* of frame 7 and through the frame plate 22*a* of frame 22 for the upper and lower profiling heads respectively. The other lateral positioner in the tandem pair extends through the corresponding frame plate a further distance so that the longer extending lateral positioner cooperates with the profiling head most closely adjacent its frame plate and the shorter extending lateral positioner cooperates with the profiling head furthest from the corresponding frame plate. Thus in the illustrated embodiment, lateral positioner 35 extends through frame plate 7*a* and past profiling head 10 so as to selectively laterally translate profiling head 15. Similarly, lateral positioner 45 extends through frame plate 22*a* past profiling head 25, so as to selectively laterally translate profiling head 30. Lateral positioner 36 extends through an aperture in frame plate 7*a* so as to selectively laterally position profiling head 10. Lateral positioner 46 extends through an aperture in frame plate 22*a* so as to selectively laterally translate profiling head 25.

As may be seen, in the illustrated embodiment which is not intended to be limiting, the arm or ram extending from the lateral positioners is rigidly mounted at its distal end to the corresponding frame plate so that the positioner cylinder itself actually moves laterally as the lateral linear positioner is actuated. The positioner cylinder is mounted to a cylindrical member such as a sleeve or shaft which extends from the cylinder through its aperture in the corresponding fame plate and so as to extend to its corresponding profiling head assembly. The distal end of the cylindrical member (cylindrical members 35*b*, 36*b*, 45*b*, and 46*b* corresponding respectively to linear positioners 35, 36, 45 and 46) are mounted to their corresponding coupling plates, respectively, coupling plates 15*a*, 10*a*, 30*a* and 25*a*. One end of the coupling plate is mounted to the corresponding cylindrical member, and the other end is mounted to the side of the corresponding profiling head so that lateral translation of the cylindrical member by the lateral positioner, laterally translates both the corresponding coupling plate and profiling head. The profiling heads are rotated on their corresponding spline shafts as the spline shafts are rotated, and thus the profiling heads are free to rotate about the axis of rotation of their spline shafts relative to their corresponding coupling plate. Thus the profiling heads are mounted by means of bearing collars (10*b*, 15*b*, 25*b* and 30*b* for, respectively, coupling plates 10*a*, 15*a*, 25*a* and 30*a*) so that the profiling heads are free to rotate on their spline shafts as they are simultaneously laterally positioned along the spline shafts by lateral translation of the coupling plates.

Feed roller assemblies 95*a* and 95*b* are provided for, respectively, the upper chipping head assembly 1*a* and the lower chipping head assembly 1*b*, and feed roller assemblies 100*a* and 100*b* are provided for, respectively, upper profiling head assembly 2*a* and lower profiling head assembly 2*b*. Each of the feed roller assemblies are rotatable about the axis of rotation of their corresponding drive shaft. Thus feed roller assemblies 95*a* and 95*b* are mounted, along with their anvils 96, so as to rotate about, respectively, chipping head drive shafts 105*a* and 105*b*. Similarly, feed roller assemblies 100*a* and 100*b* are mounted on rotatable frame assemblies 110*a* and 110*b* so as to rotate about the axes of rotation of, respectively, drive shafts 5 and 20. Feed roller assemblies 95*a* and 95*b* are selectively rotatable about their corresponding drive shafts 105*a* and 105*b* by means of vertically disposed linear positioners in a manner similar to vertical linear positioners 115*a* and 115*b* selectively rotating feed roller assemblies 100*a* and 100*b* about their corresponding drive shafts 5 and 20. Feed rollers 120*a* and 120*b* are mounted on corresponding shafts 125*a* and 125*b*. Shafts 125*a* and 125*b* are journalled through corresponding rotatable frames 110*a* and 110*b* and through corresponding bearing plates 10*b* and 15*b* in respect of upper profiling assembly 2*a*, and 25*b* and 30*b* in respect of lower profiling assembly 2*b*. The feed roller assemblies may thus be rotated about their corresponding profiling head drive shafts so as to follow the curvature of cant 40 as cant 40 is fed through the profiling assemblies for example in the case that cant 40 is curved in a vertical plane, it ordinarily being the case that a curved cant would have been rotated upstream so as to present typically horns-down into the chipping head assemblies 1*a* and 1*b* and the profiling head assemblies 2*a* and 2*b* before passing to a vertical arbor curve sawing gang 3.

Frames 7 and 22 are guided vertically along guide shafts 60 by means of slide blocks 60*a* slidably mounted onto guide shafts 60 and rigidly mounted to plates 7*a* and 22*a*.

Similarly, the chipping head assemblies 1*a* and 1*b* are also selectively vertically translated by means of their corresponding vertical linear positioners 130*a* and 130*b* selectively vertically translating their corresponding chipping head mounting frames 135*a* and 135*b* by means again of slide blocks 60*a* rigidly mounted to the frames 135*a* and 135*b* sliding along guide shafts 60.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An apparatus for adjustably profiling a cant relative to the longitudinal centreline of the cant, the apparatus comprising:

a first and a second shaft, said first and said second shaft rotatably mounted to a first frame and a second frame, respectively;

a first and a second pair of laterally spaced apart profile cutting devices, said first and said second pair of laterally spaced apart profile cutting devices slidably mounted to said first shaft and said second shaft, respectively;

selectively actuable first and second pair of lateral linear positioners mounted to said first and said second frame, respectively, each lateral linear positioner of each of said first and said second pairs of lateral linear positioners selectively actuable to independently or in unison laterally displace each profile cutting device of each of said first and said second pairs of laterally spaced apart profile cutting devices, respectively, relative to the longitudinal centreline of the cant when said first and said second pairs of lateral linear positioners are actuated;

first and second vertical linear positioners mounted to said first and said second frame, respectively, said first and said second vertical linear positioners selectively vertically displacing, respectively, said first and second frames and corresponding said first and said second pairs of laterally spaced apart profile cutting devices, respectively, relative to the longitudinal centreline of the cant when said first and said second vertical linear positioners are actuated.

2. The apparatus of claim 1 further comprising a third and a fourth linear positioner mounted to said first and said second frame, respectively, said third and said fourth linear positioners selectively actuable to angularly displace said first and said second pairs of laterally spaced apart profile cutting devices, respectively, relative to the longitudinal centreline of the cant when said third and said fourth linear positioners are actuated.

3. The apparatus of claim 2 wherein said third and said fourth linear positioners selectively angularly displace said first and said second pairs of laterally spaced apart profile cutting devices relative to the longitudinal centreline of the cant, respectively, such that said first and said second pairs of laterally spaced apart profile cutting devices independently or cooperatively angularly displace relative to each other.

4. The apparatus of claim 3 wherein said first and said second vertical linear positioners selectively vertically displace said first and said second pairs of laterally spaced apart profile cutting devices relative to the longitudinal centreline of the cant, respectively, such that said first and said second laterally pairs of spaced apart profile cutting devices independently or cooperatively vertically displace relative to each other.

5. The apparatus of claim 4 further comprising a first and a second eccentric cams, said first and said second eccentric cams pivotally coupled with said third and said fourth linear positioners, respectively, such that actuation of said third and said fourth linear positioners causes said first and said second eccentric cams to bear against and thereby rotate said first and second frames respectively.

6. The apparatus of claim 5 wherein said first and second frames are vertically slidably mounted on at least one vertical guide shaft, and wherein each of said first and said second eccentric cams is rotatably and eccentrically mounted to said at least one vertical guide shaft such that rotation of said first and said second eccentric cams about said at least one vertical guide shaft causes said first and said second eccentric cams to bear against said first and second frames, respectively, thereby angularly displacing said first and said second frame, causing said first and said second pair of laterally spaced apart profile cutting devices to displace angularly with respect to the centreline of the cant.

7. The apparatus of claim 6 wherein said first and said second shafts are splined drive shafts.

8. The apparatus of claim 7 wherein said first and said second pair of laterally spaced apart profile cutting devices are profiling heads, said profiling heads for removing corresponding notches from and along wane corners of the cant.

* * * * *